US011346512B1

(12) United States Patent
Hsieh

(10) Patent No.: US 11,346,512 B1
(45) Date of Patent: May 31, 2022

(54) LIGHT FIXTURE

(71) Applicant: HABITEX CORPORATION, Taipei (TW)

(72) Inventor: Pei-Lin Hsieh, Taipei (TW)

(73) Assignee: HABITEX CORPORATION, Taipei (TW)

( * ) Notice: Subject to any disclaimer, the term of this patent is extended or adjusted under 35 U.S.C. 154(b) by 0 days.

(21) Appl. No.: 17/516,579

(22) Filed: Nov. 1, 2021

(30) Foreign Application Priority Data

May 8, 2021 (CN) ..... 202120969237.6

(51) Int. Cl.
*F21S 6/00* (2006.01)
*F21V 21/14* (2006.01)
*F21V 1/14* (2006.01)
*F21V 1/02* (2006.01)

(52) U.S. Cl.
CPC ..... *F21S 6/005* (2013.01); *F21V 1/143* (2013.01); *F21V 21/14* (2013.01); *F21V 1/02* (2013.01)

(58) Field of Classification Search
CPC .. F21S 6/005; F21V 1/143; F21V 1/02; F21V 21/14
USPC ..... 362/410, 353, 351, 358
See application file for complete search history.

(56) References Cited

U.S. PATENT DOCUMENTS 3,142,446 A * 7/1964 Okamoto ..... F21V 1/06 206/226
6,860,619 B2 * 3/2005 Swanson ..... F21V 21/02 362/249.11
8,136,968 B2 * 3/2012 Chiu ..... F21V 1/00 362/357
9,777,902 B1 * 10/2017 Katterheinrich ..... F21V 1/04

* cited by examiner

*Primary Examiner* — Laura K Tso
(74) *Attorney, Agent, or Firm* — Ladas & Parry, LLP

(57) ABSTRACT

A light fixture includes a supporting unit and a lighting unit including a light emitting module and a lamp shield. The light emitting module includes a base wall and a connecting assembly including a connecting rod connected between the base wall and the support unit, and a connecting sleeve sleeved on and engaging threadedly the connecting rod. The lamp shield includes a fixing plate formed with a peripheral notch permitting the threaded segment to extend removably therethrough so as to be removably clamped between the connecting sleeve and the base wall.

7 Claims, 8 Drawing Sheets

LIGHT FIXTURE

CROSS-REFERENCE TO RELATED APPLICATION

This application claims priority of Chinese Utility Model Patent Application No. 202120969237.6, filed on May 8, 2021, the disclosure of which is incorporated herein by reference in its entirety.

FIELD

The disclosure relates to a light fixture, more particularly to a light fixture including a detachable lamp shield or lamp shade.

BACKGROUND

Referring to FIG. 1, a lamp shield 9 of a conventional light fixture includes a surrounding wall 91 and a mounting frame 92 connected to the surrounding wall 91. The mounting frame 92 includes a ring body 921 connected to a lamp holder (not shown) and a plurality of supporting rods 922 interconnecting the ring body 921 and the surrounding wall 91. The ring body 921 is provided for a lamp (not shown) to extend therethrough such that the lamp is connected to the lamp holder and a light emitting portion of the lamp is located in the surrounding wall 91.

When this type of lamp shield 9 is to be assembled, it is required to assemble the lamp shield 9 and the lamp holder together prior to connecting the lamp to the lamp holder. Moreover, to detach the lamp shield 9 from the lamp holder, the lamp must be detached from the lamp holder in advance, so that the operation process of detaching the lamp shield 9 is inconvenient.

SUMMARY

Therefore, an object of the disclosure is to provide a light fixture that has a lamp shield and that is simple to assemble and dissemble.

According to an aspect of the disclosure, a light fixture including a supporting unit and at least one lighting unit is provided. The supporting unit includes a supporting seat and a supporting frame connected to the supporting seat. The lighting unit includes a light emitting module and a lamp shield. The light emitting module includes a mounting seat, a connecting assembly, and a light emitting component. The mounting seat includes a base wall. The connecting assembly includes a hollow connecting rod and a connecting sleeve. The connecting rod is connected between the base wall and the supporting frame. The connecting sleeve is sleeved on the connecting rod and is disposed above the base wall along a vertical direction. The connecting rod has an outer surface formed with a threaded segment connected to the base wall. The connecting sleeve has an inner surface formed with a thread engaging the threaded segment so that the connecting sleeve is rotatable relative to the threaded segment and movable along the threaded segment. The light emitting component is disposed in the mounting seat and under the base wall along the vertical direction, and is adapted to emit a light beam. The lamp shield includes a shield body surrounding the light emitting module and a connecting bracket. The connecting bracket includes a fixing plate and a plurality of rod bodies connected between the fixing plate and the shield body. The fixing plate is formed with a peripheral notch permitting the threaded segment to extend removably therethrough. The fixing plate is removably clamped between the connecting sleeve and the base wall.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
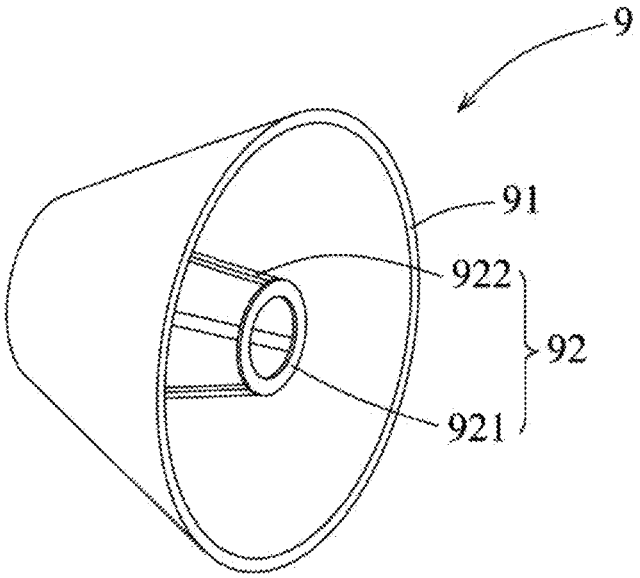
FIG.1 PRIOR ART
FIG. 1 is a schematic perspective view of a lamp shield of a conventional light fixture.

Before the present disclosure is described in greater detail, it should be noted herein that like elements are denoted by the same reference numerals throughout the disclosure.

Figure 2:
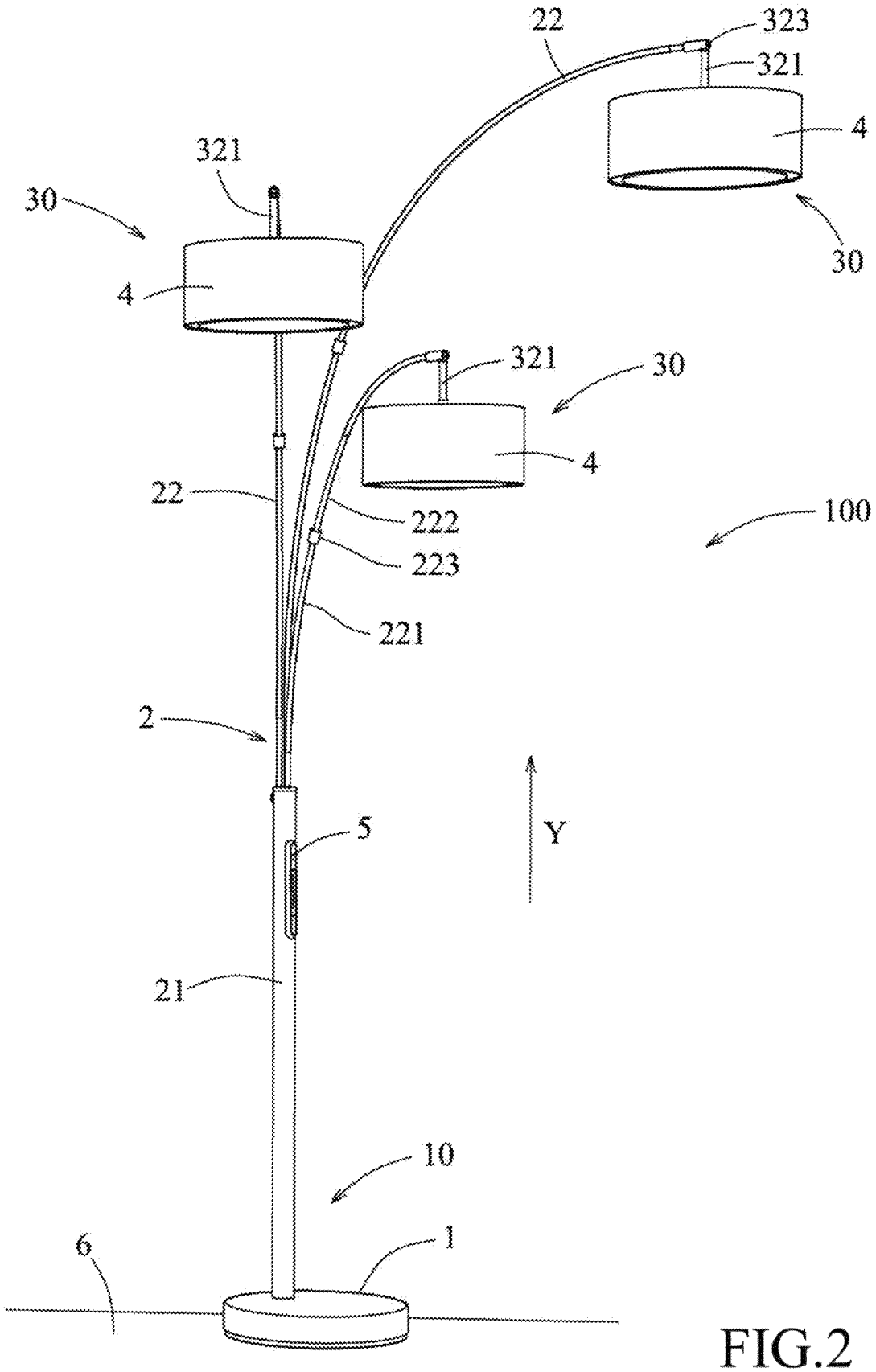
FIG. 2 is a perspective view of a first embodiment according to a light fixture of the present disclosure.

Referring to FIG. 2, a light fixture 100 according to a first embodiment of the present disclosure is shown to include a supporting unit 10 and a plurality of lighting units 30.

Figure 3:
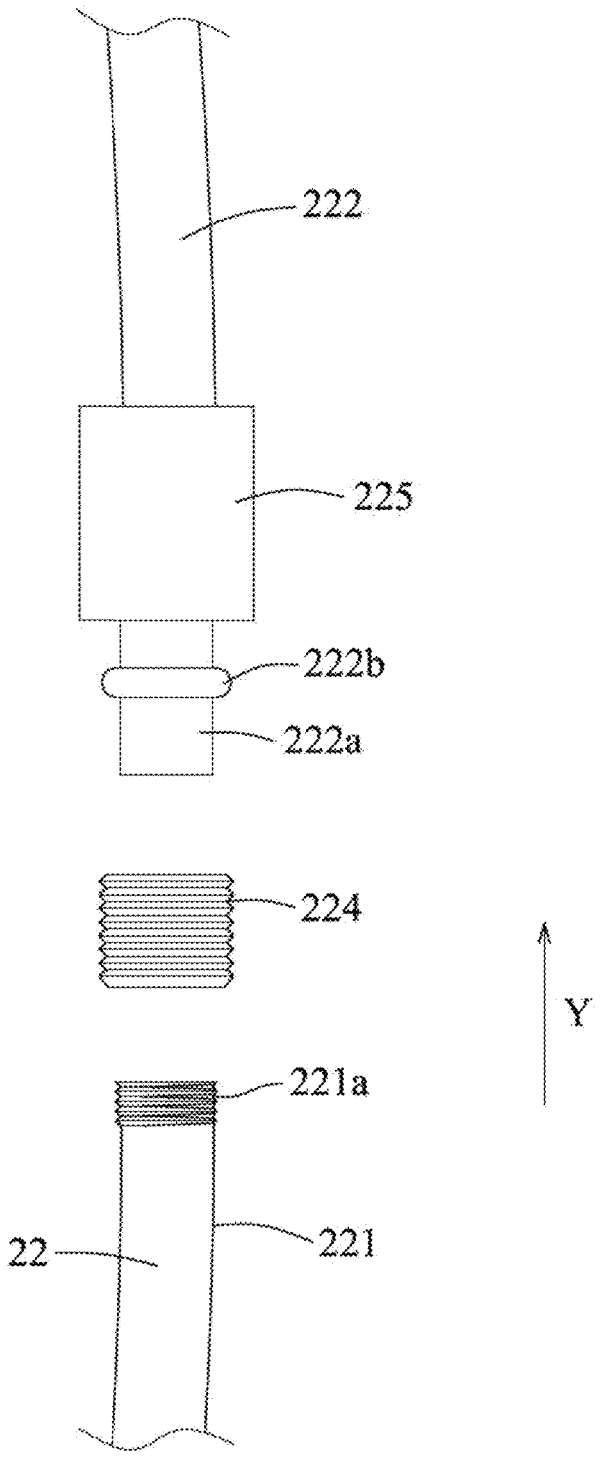
FIG. 3 is a fragmentary schematic partly exploded view of a supporting frame of the first embodiment.
Figure 4:
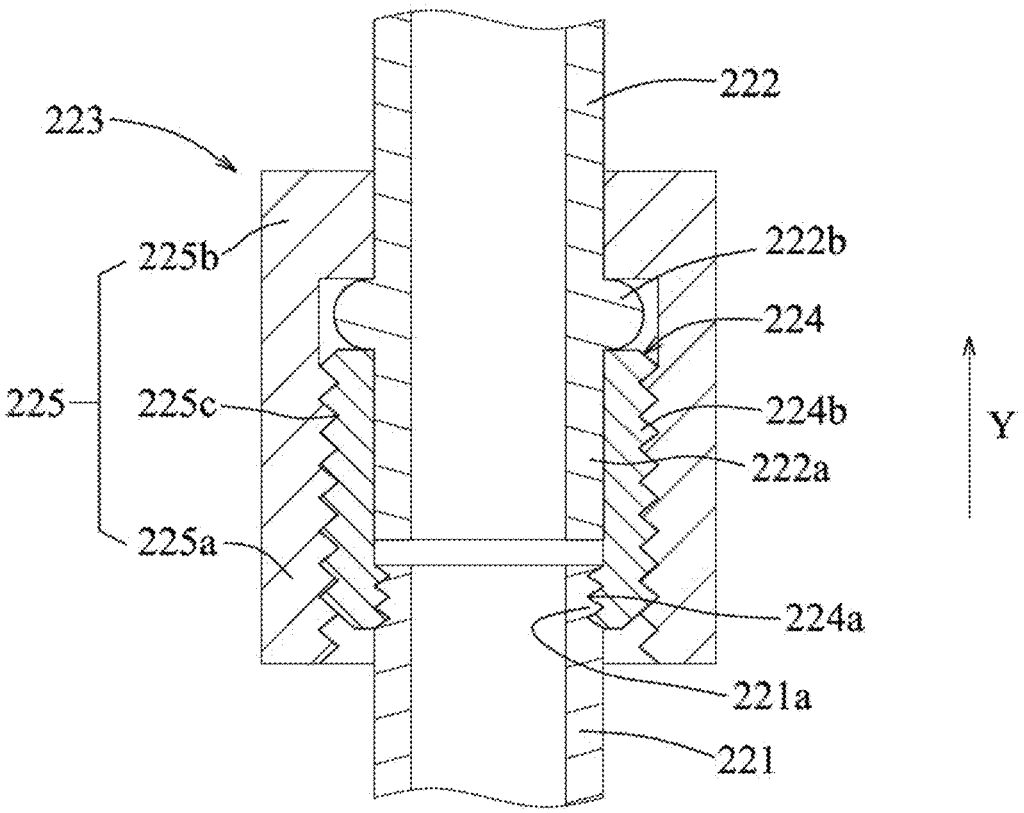
FIG. 4 is a fragmentary schematic sectional view of the supporting frame of the first embodiment.

Further referring to FIGS. 3 and 4, the supporting unit 10 includes a supporting seat 1 and a supporting frame 2 connected to the supporting seat 1. In this embodiment, the supporting seat 1 is adapted to be placed on a supporting surface 6, such as a ground or a desktop. The supporting frame 2 includes a hollow upright pillar 21 extending upwardly along a vertical direction (Y) from the supporting seat 1, and a plurality of extension rods 22 extending upwardly and bent from a top end of the upright pillar 21. Each of the extension rods 22 includes a first rod segment 221, a second rod segment 222, and a fastening assembly 223 connected removably to the first and second rod segments 221, 222 for connecting the first rod segment 221 fixedly to the second rod segment 222.

Since the structures of the extension rods 22 are identical, only one of the extension rods 22 will be described in the following description. The first rod segment 221 includes a fastening portion 221*a* disposed adjacent to an end of the second rod segment 222 and formed with an external thread thereon. The second rod segment 222 includes a sleeved end portion 222*a* disposed adjacent to an end of the first rod segment 221 and a stop flange 222*b* extending radially and outwardly from the sleeved end portion 222*a*. The fastening assembly 223 includes an inner fastening member 224 and an outer fastening member 225. The inner fastening member 224 is sleeved on the fastening portion 221*a* of the first rod segment 221 and the sleeved end portion 222*a* of the second rod segment 222, has an inner peripheral surface and an outer peripheral surface, and includes a first internal threaded portion 224*a* and an external threaded portion 224*b*. The first internal threaded portion 224*a* is formed on the inner peripheral surface and threadedly engages the fastening portion 221*a*. The external threaded portion 224*b* is formed on the outer peripheral surface.

The outer fastening member 225 has a large inner diameter portion 225*a* sleeved on the inner fastening member 224 and a small inner diameter portion 225*b* sleeved on the second rod segment 222 and having an inner diameter smaller than that of the large inner diameter portion 225*a*. The large inner diameter portion 225*a* has an inner circumferential surface formed with a second internal threaded portion 225*c* threadedly engaging the external threaded portion 224*b*. The small inner diameter portion 225*b* and the inner fastening member 224 respectively abut against two opposite sides of the stop flange 222*b* along the vertical direction (Y), so as to fix the second rod segment 222 relative to the first rod segment 221.

In this way, it is relatively simple to disassemble and assemble the extension rods 22. Additionally, the hollow structures of the upright pillar 21 and the extension rods 22 are provided for electric cables (not shown) to extend therethrough.

Figure 5:
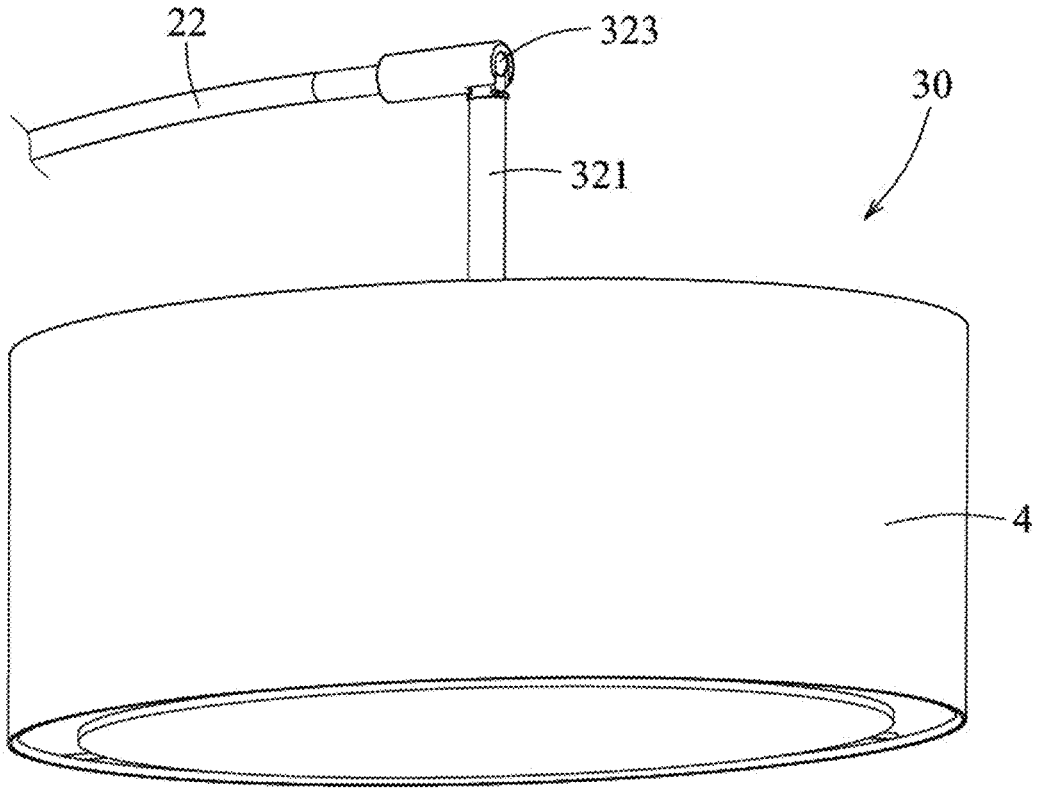
FIG. 5 is a fragmentary schematic perspective view of a light emitting module, a lamp shield, and the supporting frame of the first embodiment.
Figure 6:
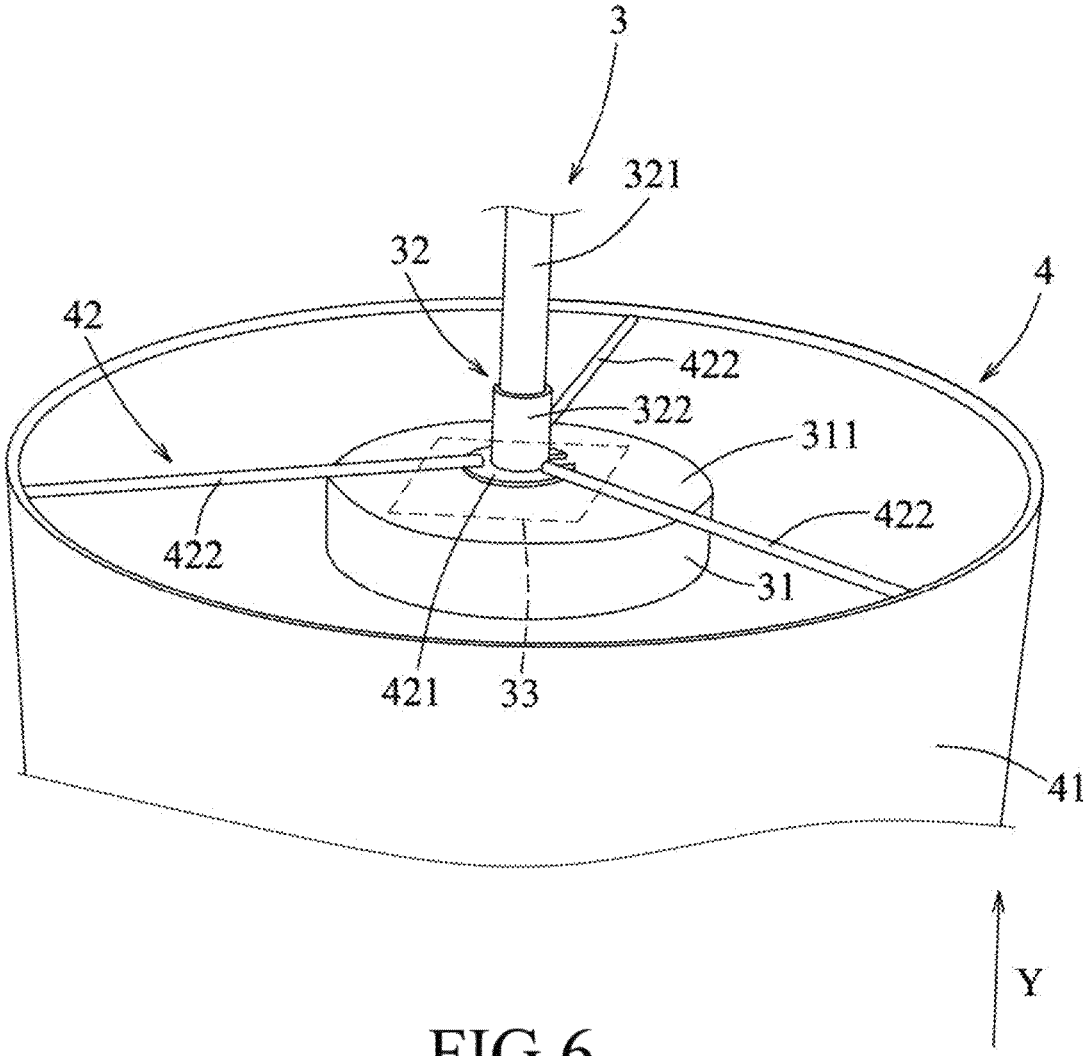
FIG. 6 is a fragmentary top perspective view of the first embodiment, illustrating the light emitting module and the lamp shield.
Figure 7:
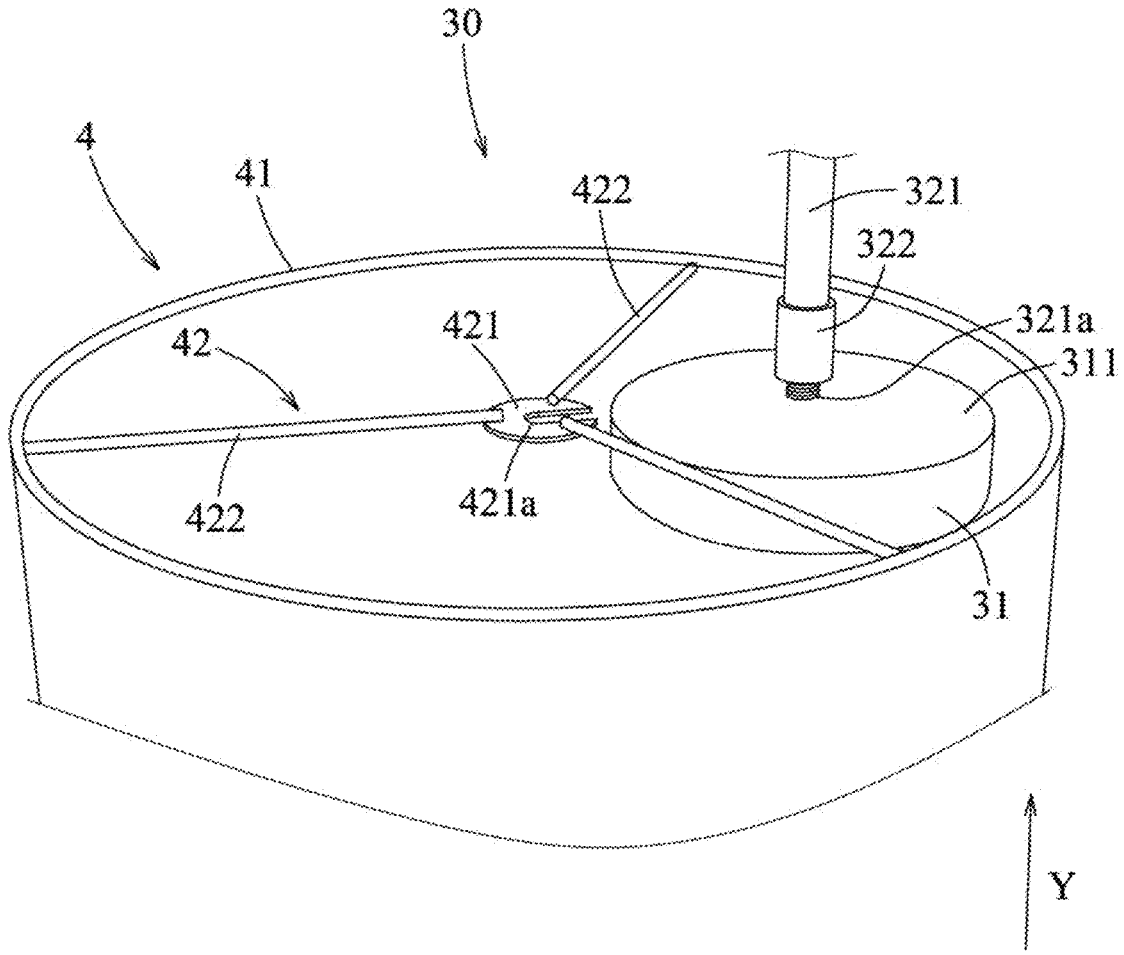
FIG. 7 is similar to FIG. 6 and is a fragmentary schematic partly exploded perspective view of the first embodiment.

Further referring to FIGS. 5 to 7, each of the lighting units 30 is connected to a distal end of a respective one of the extension rods 22. Each of the lighting unit 30 includes a light emitting module 3 and a lamp shield or lamp shade 4. The light emitting module 3 includes a mounting seat 31, a connecting assembly 32, and a light emitting component 33. The mounting seat 31 includes a base wall 311. In this embodiment, the mounting seat 31 is specifically a light transmissive hollow seat.

The light emitting component 33 includes a circuit board (not shown) and a plurality of light emitting diodes (LEDs) mounted on the circuit board, disposed in the mounting seat 31 and under the base wall 311 along the vertical direction (Y), and adapted to emit a light beam in a direction away from the base wall 311 and the connecting assembly 32. In other embodiments, the light emitting component 33 may be, for example, a tungsten lamp, a halogen lamp, or the like and the present disclosure is not limited in this respect.

The connecting assembly 32 includes a hollow connecting rod 321 that is connected between the base wall 311 and the supporting frame 2, and a connecting sleeve 322 that is sleeved on the connecting rod 321 and that is disposed above the base wall 311 along the vertical direction (Y). The connecting rod 321 has an outer surface formed with a threaded segment 321*a* connected threadedly to the base wall 311. The connecting sleeve 322 has an inner surface formed with a thread engaging the threaded segment 321*a* so that the connecting sleeve 322 is rotatable relative to the threaded segment 321*a* and movable along the threaded segment 321*a*.

The lamp shield 4 includes a shield body 41 surrounding the light emitting module 3 and a connecting bracket 42. The connecting bracket 42 includes a fixing plate 421 disposed at a central portion thereof, and a plurality of rod bodies 422 connected between the fixing plate 421 and the shield body 41. The fixing plate 421 is formed with a peripheral notch 421*a* permitting the thread segment 321*a* to extend removably therethrough. During assembly, when the fixing plate 421 is placed into a space between the connecting sleeve 322 and the base wall 311, the connecting sleeve 322 is moved toward the fixing plate 421 through rotation of the connecting sleeve 322 relative to the thread segment 321 in a clockwise direction, to press the fixing plate 421 against the base wall 311, thereby removably clamping the fixing plate 421 between the connecting sleeve 322 and the base wall 311. In this way, the lamp shield 4 can be assembled fixedly to the light emitting module 3. When it is desired to detach the lamp shield 4, the connecting sleeve 322 is rotated relative to the thread segment 321 in a counterclockwise direction to move away from the fixing plate 421, so that the lamp shield 4 can be separated from the light emitting module 3 without detaching additional components.

Thus, the operation process of assembling the lamp shield 4 to the light emitting module 3 is relatively simple and convenient, and the operation process of detaching the lamp shield 4 from the light emitting module 3 is also convenient, which facilitates maintenance and transportation of the light fixture 100.

In this embodiment, the connecting assembly 32 further includes a universal joint 323 interconnecting the connecting rod 321 and the supporting frame 2, which enables the connecting rod 321 to universally rotate relative to the supporting frame 2 to adjust an angle of the light beam emitted by the light emitting component 33 relative to the supporting frame 2 so as to adjust an illumination area of the lighting unit 30.

Referring back to FIG. 2, in this embodiment, the connecting rod 321 of each of the lighting units 30 is connected to the distal end of a corresponding one of the extension rods 22, and the hollow configuration of the connecting rods 321 permits the electric cables to extend therethrough. As such, the light emitting components 33 are electrically connected to a power source (not shown) through the electric cables. The power source may be a rechargeable battery built in the supporting seat 1 or an external power source such as mains electricity. The external power source may be electrically connected to the light emitting components 33 through the electric cables connected to the light emitting components 33 and extending outwardly from the supporting seat 1.

In this embodiment, a switch module 5 is provided on the upright pillar 21 for a user to operate and control operation of the lighting unit 30. In other embodiments, the supporting frame 2 includes only one extension rod 22, and only one lighting unit 30.

Figure 8:
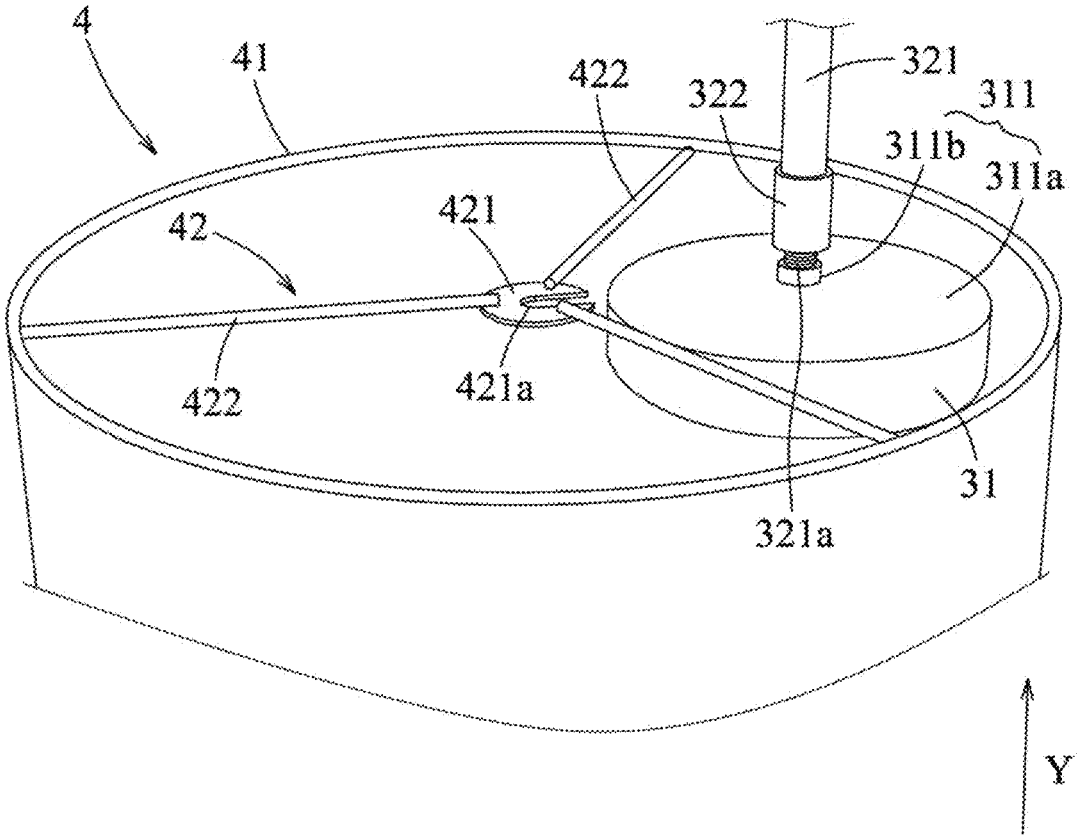
FIG. 8 is a fragmentary schematic partly exploded perspective view of a second embodiment according to the light fixture of the present disclosure.

Referring to FIG. 8, a second embodiment of the lighting device 100 according to the present disclosure is similar to the first embodiment, and the difference therebetween resides in the following. In the second embodiment, the base wall 311 of the mounting seat 31 includes a wall body 311*a* and a platform 311*b* extending from the wall body 311*a* along the vertical direction (Y) toward the connecting sleeve 322, and the fixing plate 421 is clamped between the connecting sleeve 322 and the platform 311*b*.

In view of the above, for each of the lighting units 30, the connecting sleeve 322 is rotatable and movable relative to the threaded segment 321*a* of the connecting rod 321 through the structures of the connecting sleeve 322 of the connecting assembly 32 and the fixing plate 421 of the lamp shield 4 formed with the peripheral notch 421*a* that permits the threaded segment 321*a* to extend removably therethrough, which makes it convenient to assemble the lamp shield 4 to the light emitting module 3 by clamping the fixing plate 421 between the connecting sleeve 322 and the base wall 311, and it is convenient to detach and separate the lamp shield 4 from the light emitting module 3.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment, "an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A light fixture comprising:

a supporting unit including a supporting seat and a supporting frame connected to said supporting seat; and at least one lighting unit including a light emitting module including a mounting seat, a connecting assembly, and a light emitting component, said mounting seat including a base wall, said connecting assembly including a hollow connecting rod that is connected between said base wall and said supporting frame, and a connecting sleeve that is sleeved on said connecting rod and that is disposed above said base wall along a vertical direction, said connecting rod having an outer surface formed with a threaded segment connected to said base wall, said connecting sleeve having an inner surface formed with a thread engaging said threaded segment so that said connecting sleeve is rotatable relative to said threaded segment and movable along said threaded segment, said light emitting component being disposed in said mounting seat and under said base wall along the vertical direction, and adapted to emit a light beam, and a lamp shield including a shield body surrounding said light emitting module, and a connecting bracket, said connecting bracket including a fixing plate and a plurality of rod bodies connected between said fixing plate and said shield body, said fixing plate being formed with a peripheral notch permitting said threaded segment to extend removably therethrough, said fixing plate being removably clamped between said connecting sleeve and said base wall.

2. The light fixture as claimed in claim 1, wherein said supporting seat is adapted to be placed on a supporting surface, said supporting frame including a hollow upright pillar extending upwardly along the vertical direction from said supporting seat, and a hollow extension rod extending upwardly and bent from a top end of said upright pillar, said extension rod having a distal end connected to said lighting unit.

3. The light fixture as claimed in claim 2, wherein said extension rod includes a first rod segment, a second rod segment, and a fastening assembly connected removably to said first rod segment and said second rod segment for connecting said first rod segment fixedly to said second rod segment, said first rod segment including a fastening portion disposed adjacent to an end of said second rod segment and being formed with an external thread thereon, said second rod segment including a sleeved end portion disposed adjacent to an end of said first rod segment, and a stop flange extending radially and outwardly from said sleeved end portion, said fastening assembly including an inner fastening member and an outer fastening member, said inner fastening member being sleeved on said fastening portion of said first rod segment and said sleeved end portion of said second rod segment, having an inner peripheral surface and an outer peripheral surface, and including a first internal threaded portion formed on said inner peripheral surface and threadedly engaging said fastening portion, and an external threaded portion formed on said outer peripheral surface, said outer fastening member including a large inner diameter portion sleeved on said inner fastening member, and a small inner diameter portion sleeved on said second rod segment and having an inner diameter smaller than that of said large inner diameter portion, said large inner diameter portion having an inner circumferential surface formed with a second internal threaded portion threadedly engaging said external threaded portion, said small inner diameter portion and said inner fastening member abutting respectively against two opposite sides of said stop flange along the vertical direction, so as to fix said second rod segment relative to said first rod segment.

4. The light fixture as claimed in claim 1, comprising a plurality of said lighting units, wherein said supporting seat is adapted to be placed on a supporting surface, said supporting frame including a hollow upright pillar extending upwardly along the vertical direction from said supporting seat, and a plurality of extension rods extending upwardly and bent from a top end of said upright pillar, each of said extension rods having a distal end connected to a respective one of said lighting units.

5. The light fixture as claimed in claim 4, wherein each of said extension rods includes a first rod segment, a second rod segment, and a fastening assembly connected removably to said first rod segment and said second rod segment for connecting said first rod segment fixedly to said second rod segment, said first rod segment including a fastening portion disposed adjacent to an end of said second rod segment and being formed with an external thread thereon, said second rod segment including a sleeved end portion disposed adjacent to an end of said first rod segment and a stop flange extending radially and outwardly from said sleeved end portion, said fastening assembly including an inner fastening member and an outer fastening member, said inner fastening member being sleeved on said fastening portion of said first rod segment and said sleeved end portion of said second rod segment, having an inner peripheral surface and an outer peripheral surface, and including a first internal threaded portion formed on said inner peripheral surface and threadedly engaging said fastening portion, and an external threaded portion formed on said outer peripheral surface, said outer fastening member including a large inner diameter portion sleeved on said inner fastening member and a small inner diameter portion sleeved on said second rod segment and having an inner diameter smaller than that of said large inner diameter portion, said large inner diameter portion having an inner circumferential surface formed with a second internal threaded portion threadedly engaging said external threaded portion, said small inner diameter portion and said inner fastening member abutting respectively against two opposite sides of said stop flange along the vertical direction, so as to fix said second rod segment relative to said first rod segment.

6. The light fixture as claimed in claim 1, wherein said base wall includes a wall body and a platform extending from said wall body along the vertical direction toward said connecting sleeve and connected to said threaded segment of said connecting rod, said fixing plate being clamped between said connecting sleeve and said platform.

7. The light fixture as claimed in claim 1, wherein said connecting assembly further includes a universal joint interconnecting said connecting rod and said supporting frame, which enables said connecting rod to universally rotate relative to said supporting frame to adjust an angle of the light beam emitted by said light emitting component relative to said supporting frame.

* * * * *